US006049310A

United States Patent [19]

Sadahiro

[11] Patent Number: 6,049,310

[45] Date of Patent: Apr. 11, 2000

[54] VARIABLE DIRECTIVITY ANTENNA AND METHOD OF CONTROLLING VARIABLE DIRECTIVITY ANTENNA

[75] Inventor: Keiichi Sadahiro, Tokyo, Japan

[73] Assignee: Mitsubishi Denki Kabushiki Kaisha, Tokyo, Japan

[21] Appl. No.: 09/155,337

[22] PCT Filed: Mar. 28, 1997

[86] PCT No.: PCT/JP97/00861

§ 371 Date: Sep. 22, 1998

§ 102(e) Date: Sep. 22, 1998

[87] PCT Pub. No.: WO98/42041

PCT Pub. Date: Sep. 24, 1998

[51] Int. Cl.[7] ..... H01Q 1/24; H01Q 21/12

[52] U.S. Cl. ..... 343/702; 343/814; 343/815; 343/860

[58] Field of Search ..... 343/702, 725, 343/814, 815, 819, 833, 860, 832, 834; 342/417, 427, 433, 435, 434

[56] References Cited

U.S. PATENT DOCUMENTS 4,631,546 12/1986 Dumas et al. ..... 343/833
5,293,172 3/1994 Lamberty et al. ..... 343/815
5,767,807 6/1998 Prichett ..... 343/833

FOREIGN PATENT DOCUMENTS 5533372 3/1980 Japan .
5826207 8/1981 Japan .

*Primary Examiner*—Don Wong
*Assistant Examiner*—Tan Ho
*Attorney, Agent, or Firm*—Rothwell, Figg, Ernst & Kurz

[57] ABSTRACT

Described herein is a variable directional antenna apparatus wherein an electrical length of a parasitic antenna of a paired two-element Yagi antenna is varied to change antenna directivity. A radio device (12) outputs a received signal corresponding to the intensity of an electric field received by a first antenna. A control circuit (15) outputs a control signal to a variable impedance circuit (14) according to the result of detection of the received signal so as to change the impedance of the variable impedance circuit (14) according to the control signal. Thus, an electrical length of a second antenna (13) placed in parallel away from the first antenna (10) is changed to thereby activate the second antenna as a director or reflector, whereby antenna directivity is varied.

14 Claims, 11 Drawing Sheets

FIG.16 (a)
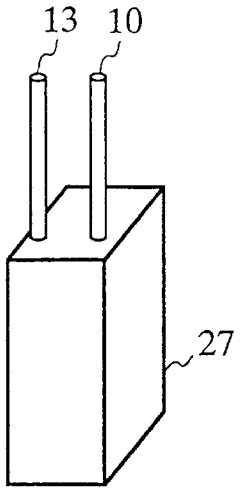
FIG.16 (b)
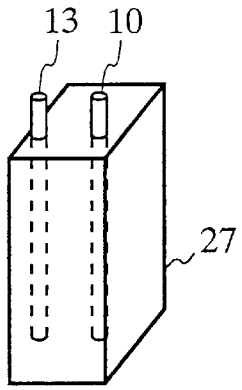
FIG.17 (a)
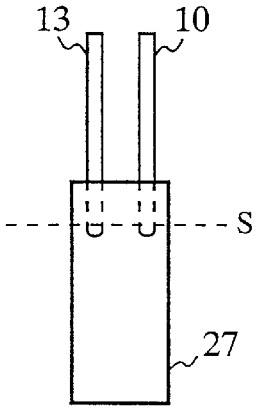
FIG.17 (b)
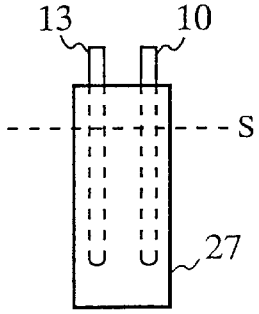
FIG.18 (a)
FIG.18 (b)
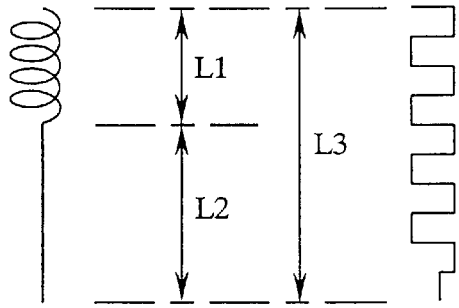

VARIABLE DIRECTIVITY ANTENNA AND METHOD OF CONTROLLING VARIABLE DIRECTIVITY ANTENNA

TECHNICAL FIELD

This invention relates to a variable directional antenna apparatus wherein the directivity of the antenna employed in a radio apparatus such as a portable radio apparatus is varied in order reduce a fall in the intensity of an electric field at a receiving position. The invention also relates to a method of controlling a variable directional antenna.

BACKGROUND ART

In the mobile radio communications of a portable phone or the like, when reflected waves are involved, there may generally be cases in which an electric field is canceled out due to mutual interference between reflected waves and direct waves or interference between reflected waves. Also the intensity of an electric field may fall extremely depending on the location, so that the mobile unit is unable to receive. To avoid such an event, space, polarization and frequency diversity systems have heretofore been used. FIG. 20 illustrates one example of the space diversity system. Reference numerals 1(*a*) and 1(*b*) respectively indicate antennas provided at positions where they are away from each other. Reference numeral 2 indicates a receiver and reference numeral 3 indicates a diversity antenna selector switch. The space diversity system is constructed so as to selectively connect that one of the respective antennas 1(*a*) and 1(*b*) having a high received level to the receiver 2 through the diversity antenna selector switch 3. In the space diversity system, however, the achievement of sufficient diversity requires sufficient separation of the respective antennas 1(*a*) and 1(*b*) from each other, thereby resulting in an increase in the size of the apparatus. Further, a problem arises in that since the selector switch 3 serves so as to switch between high-frequency signals, it is generally expensive and is expensive to replace Also noise is produced when the selector switch 3 is changed over.

Therefore, an apparatus in which the directivity of each antenna is varied to reduce the influence of a reflected wave, has been produced. As has been disclosed in, for example, Japanese Utility Model Application Laid-Open No. 58-26207, [Antenna apparatus for Mobile Radio Device] shown in FIG. 21, a non-feed or parasitic antenna 7 is set between a transmitting antenna 5 electrically connected to a transmitter 4 and a receiving antenna 6 electrically connected to a receiver 2 so as to act as either a reflector or a director. Further, the parasitic antenna 7 is loaded in series with a switching element 8 (or variable impedance element). A drive circuit 9 turns on and off the switching element 8 on and off to vary the current distribution of the corresponding antenna, thereby varying the directivity of the antenna. FIG. 22 is a block diagram showing the well-known principle of a one pair of half-waves (hereinafter called "$\lambda/2$", where $\lambda$:wavelength) in the two-element Yagi type antenna. Reference numeral 5 indicates a power-fed transmitting antenna, reference numeral 7 indicates a non-feed or parasitic antenna, and reference numeral 4 indicates a transmitter. Assuming the electrical length of the feed antenna 5 is taken as $\lambda/2$, the parasitic antenna 7 is generally activated as a reflector if the electrical length thereof is set so as to be slightly longer than $\lambda/2$ as shown in FIG. 22(*a*), whereas if the electrical length thereof is set so as to be slightly shorter than $\lambda/2$ as shown in FIG. 22(*b*), the parasitic antenna 7 acts as a director. Thus, when the parasitic antenna 7 is set slightly longer than the transmitting antenna 5 and the receiving antenna 6 as regards electrical length as in FIG. 21, it operates as a reflector. The transmitting antenna 5 exhibits directivity in the direction of the receiving antenna 6 when the switch 8 is brought to an on state, whereas when the switch 8 is turned off, the transmitting antenna 5 exhibits directivity in the direction opposite to that of the receiving antenna 6. When the parasitic antenna 7 is set slightly shorter than the transmitting antenna 5 and the receiving antenna 6 as regards electrical length, it acts as a director and exhibits a characteristic opposite to that obtained when activated as the reflector. Since no control is effected on the transmitting antenna 5 and the receiving antenna 6, switching noise is not produced. According to the method, however, since the parasitic antenna 7 is placed between the transmitting antenna 5 and the receiving antenna 6, a transmit wave and a receive wave are opposed to each other and their radio-wave propagation paths differ from each other in a mobile radio system requiring simultaneous transmission and reception, such as cordless telephones, portable telephones. Thus, the present method is accompanied by a drawback that even if the directivity is varied so that the receiving level is high, the transmit wave does not sufficiently reach the opposite party. A problem also arises in that since antennas dedicated to transmission and reception are necessary, the apparatus is large in size and becomes inconvenient to carry, and also the apparatus becomes expensive. Further, a problem arises in that since the parasitic antenna 7 is set to either the reflector or the director, the parasitic antenna 7 needs to sufficiently vary the impedance thereof by the switch element 8 and hence the desired directivity is hard to obtain. Moreover, a problem arises in that although there is also a method of loading a variable capacitance diode the capacitance of which varies according to a voltage applied thereto, in place of the switch element 8, the physical length of the parasitic antenna 7 must be made longer than the original length to cancel out the capacitive property of the variable capacitance diode.

Since the transmitting/receiving antennas are respectively provided separately from one another in the conventional variable directional antenna as described above, the apparatus increases in size and becomes expensive. Further, a drawback arises in that since the parasitic antenna is set to either the reflector or the director in advance, it needs to greatly vary the impedance thereof by a variable impedance circuit and the optimum directivity is hard to obtain. Further, a drawback arises in that when a variable capacitance diode is loaded in place of the switch element, the physical length of the parasitic antenna becomes long due to its capacitive property and the apparatus increases in size, thus making it inconvenient to carry.

The present invention has been made to solve the above-described problems. A first object of the present invention is to provide a variable directional antenna apparatus which lessens, in a simple configuration, abrupt reductions in field intensities at received positions of both a mobile device and a fixed device in mobile radio communications, and a method of controlling a variable directional antenna. A second object of the present invention is to provide a variable directional antenna apparatus small in size and light in weight, convenient for carrying and low in cost, and a method of controlling a variable directional antenna.

DISCLOSURE OF INVENTION

The variable directional antenna apparatus of the present invention has a radio apparatus which outputs a received signal corresponding to the intensity of an electric field received by a first antenna, and a control circuit which outputs a control signal to electrical length varying means according to the result of detection of the received signal to thereby activate a second antenna as a director or reflector. Therefore, the received intensity of electric field is monitored and the electrical length of the second antenna is arbitrarily varied so that the received intensity of electric field increases, thereby making it possible to activate the second antenna as a director or reflector as needed and obtain arbitrary directivity upon reception. Even if the field intensity at each received position is abruptly reduced under the influence of a reflected wave or an obstacle, an extreme reduction in received level can be avoided.

If the variable directional antenna apparatus according to the present invention is provided with a radio device having a transmitter-receiver device and an antenna shared unit which is electrically connected to the transmitter-receiver device and shares the first antenna between transmission and reception, and a power feeder electrically connected to the antenna shared unit and for feeding power to the first antenna, then a transmit wave and a receive wave propagate through the same path. Therefore, a similar effect can be obtained even at a received position on the opposite party side and even with respect to a transmitted radiation field by changing the received intensity of electric field.

In the variable directional antenna apparatus according to the present invention, electrical length varying means includes a variable capacitance diode whose capacitance value varies according to the voltage of a control signal, a capacitor electrically connected in series with the variable capacitance diode, and a coil electrically connected in series with the capacitor. Therefore, the electrical length of the second antenna can be varied according to the voltage applied across the variable capacitance diode. Further, the capacitive components of the variable capacitance diode and capacitor can be canceled out by the coil, and the physical length of the second antenna can be arbitrarily set by selecting the value of the coil, whereby the second antenna can be reduced in size.

In the variable directional antenna apparatus according to the present invention, since the electrical length varying means applies a control signal to the variable capacitance diode through high-frequency inhibiting means for inhibiting a high-frequency component from being passed round the control circuit, noise is not produced from passing the high-frequency component round the control circuit.

In the variable directional antenna apparatus according to the present invention, the control circuit has an A/D converter for A/D converting a received signal, a memory for storing a predetermined value therein in advance, computing means for comparing the output of the A/D converter and the predetermined value and outputting an operation signal for activating a second antenna as a director or reflector according to the result of comparison, and a D/A converter for D/A converting the operation signal into a control signal and outputting the control signal to a variable impedance circuit. Therefore, the intensity of a received electric field can be monitored by the A/D converter and the electrical length varying means can be controlled with satisfactory accuracy by the computing means through the D/A converter, whereby desired directivity can be obtained.

In the variable directional antenna apparatus according to the present invention, the control circuit includes an A/D converter for A/D converting a received signal and computing means for outputting two kinds of control signals for activating a second antenna as a director or reflector according to the output of the A/D converter. Therefore, the memory and D/A converter become unnecessary and the electrical length varying means can be controlled with satisfactory accuracy by the two kinds of control signals outputted from the computing means and the variable directional antenna apparatus can be rendered simpler in configuration.

In the variable directional antenna apparatus according to the present invention, the control circuit inputs an antenna state detected signal indicative of each of extended and stored states of the first and second antennas with respect to the body used therefor. It then outputs a control signal, which is related to the extended or stored states of the first and second antennas and which corresponds to a received signal outputted from the first antenna, to the electrical length varying means to thereby activate the second antenna held in the extended or stored states as a director or reflector. Therefore, suitable directivity can be obtained regardless of the extended or stored states of the first and second antennas.

In the variable directional antenna apparatus according to the present invention, a two-element Yagi antenna can be formed by using the first and second antennas as dipole antennas.

In the variable directional antenna apparatus according to the present invention, a two-element Yagi antenna can be formed by utilizing the first and second antenna as grounded antennas. Further, the physical length of each antenna can be shortened as compared with the dipole antenna.

In the variable directional antenna apparatus according to the present invention, each of the first and second antennas is formed of a bar-like conductor.

In the variable directional antenna apparatus according to the present invention, the formation of the first and second antennas by bending conductors makes it possible to shorten the physical length of each antenna.

In the variable directional antenna apparatus according to the present invention, since the first and second antennas are formed by mounting metal conductors on an insulating substrate, the antennas can be formed with high-dimensional accuracy by a micro-fabrication techniques such as etching machining or the like and hence a stable characteristic can be obtained.

The variable directional antenna apparatus according to the present invention comprises a first antenna having an electrical length which resonates at a predetermined frequency, a parasitic second antenna disposed away from the first antenna, a radio device for outputting a received signal corresponding to the intensity of an electric field received by the first antenna, a speaker for outputting voice sounds received by the radio device, electrical length varying means electrically connected to the second antenna for varying the electrical length of the second antenna according to a control signal, and a control circuit for outputting the control signal for varying the electrical length of the second antenna so that directivity is opposite to the sound-discharge side of the speaker during telephone operation at the radio device, the control signal being outputted to the electrical length varying means. Therefore, the field intensity can be prevented from being reduced due to obstacles such as the head and face of a person during a call.

A method of controlling a variable directional antenna, according to the present invention, comprises the following steps: a first setting step for setting the electrical length of a second antenna, which is placed away from a first antenna and whose electrical length is variably formed, so as to be shorter than the electrical length of the first antenna which is electrically connected to a receiver; a first storing step for storing, in the memory, first field intensity data corresponding to the intensity of an electric field received by the receiver in a state of the electrical length of the second antenna, which has been set in the first setting step; a second setting step for setting the electrical length of the second antenna so as to be longer than that of the first antenna; a second storing step for storing, in the memory, second field intensity data corresponding to the intensity of an electric field received by the receiver in a state of the electrical length of the second antenna, which has been set in the second setting step; and a receiving step for controlling and receiving the electrical length of the second antenna according to the result of comparison between the first field intensity data and the second field intensity data. Therefore, the received intensity of electric field is monitored and the electrical length of the second antenna is arbitrarily varied so that the received intensity of electric field increases, thereby making it possible to activate the second antenna as a director or reflector as needed and obtain arbitrary directivity upon reception. Even if the field intensity at each received position is abruptly reduced due to the influence of a reflected wave and an obstacle, an extreme reduction in received level can be avoided.

BRIEF DESCRIPTION OF DRAWINGS

FIGS. 1 through 19 illustrate preferred embodiments of variable directional antenna apparatuses according to the present invention, in which:

FIG. 1 is a block diagram showing the variable directional antenna apparatus using dipole antennas of the present invention;

FIG. 2 is a circuit diagram of a variable impedance circuit shown in FIG. 1;

FIG. 3 is a perspective view of a radio apparatus body to which the variable directional antenna apparatus shown in FIG. 1 is attached;

FIGS. 4A and 4B are diagram for explaining directivity (radiation patterns) of the antennas of the variable directional antenna apparatus shown in FIG. 1;

FIG. 5 is a diagram for describing a frame configuration of a TDMA system employed in the variable directional antenna apparatus according to the present invention;

FIG. 6 is a flowchart for describing a method of controlling the variable directional antenna apparatus of the present invention;

FIG. 8 is a perspective view of the radio apparatus body having an obstacle sensor attached to the variable directional antenna apparatus of the present invention;

FIG. 9 is a block diagram showing the variable directional antenna apparatus of the present invention, which is provided with an obstacle sensor;

FIG. 10 is a block diagram illustrating another embodiment of the variable directional antenna apparatus of the present invention, which is provided with an obstacle sensor;

FIG. 11 is a block diagram showing a variable directional antenna apparatus using grounded antennas of the present invention;

FIG. 12 is a circuit diagram of a variable impedance circuit shown in FIG. 11;

FIGS. 13A and 13B are diagram for describing the shape of an antenna conductor of the variable directional antenna apparatus of the present invention;

FIG. 14 is a diagram for describing antennas formed by mounting antenna conductors of the variable directional antenna apparatus of the present invention on an insulating substrate;

FIG. 15 is a diagram for describing antennas formed by mounting antenna conductors of the variable directional antenna apparatus of the present invention on both ends of an insulating body;

FIGS. 16A and 13B are perspective view of a radio apparatus body provided so that antennas of the variable directional antenna apparatus of the present invention can be extended and stored therein;

FIGS. 17A and 17B are side view of FIG. 16;

FIGS. 18A and 18B are an explanatory view of the antennas used in FIG. 16;

FIG. 19 is a block diagram showing a variable directional antenna apparatus provided with an antenna state sensor, according to the present invention;

BEST MODE FOR CARRYING OUT THE INVENTION

Embodiment 1:

A variable directional antenna apparatus according to an embodiment 1 of the present invention will be described based on FIGS. 1 through 7. A description will now be made applying the variable directional antenna apparatus of this invention to a radio apparatus using a time division multiple access (hereinafter called "TDMA") defined as one access method for communications of a mobile unit such as a digital portable phone given as one example.

<Variable directional antenna apparatus using dipole antennas>

Figure 1:
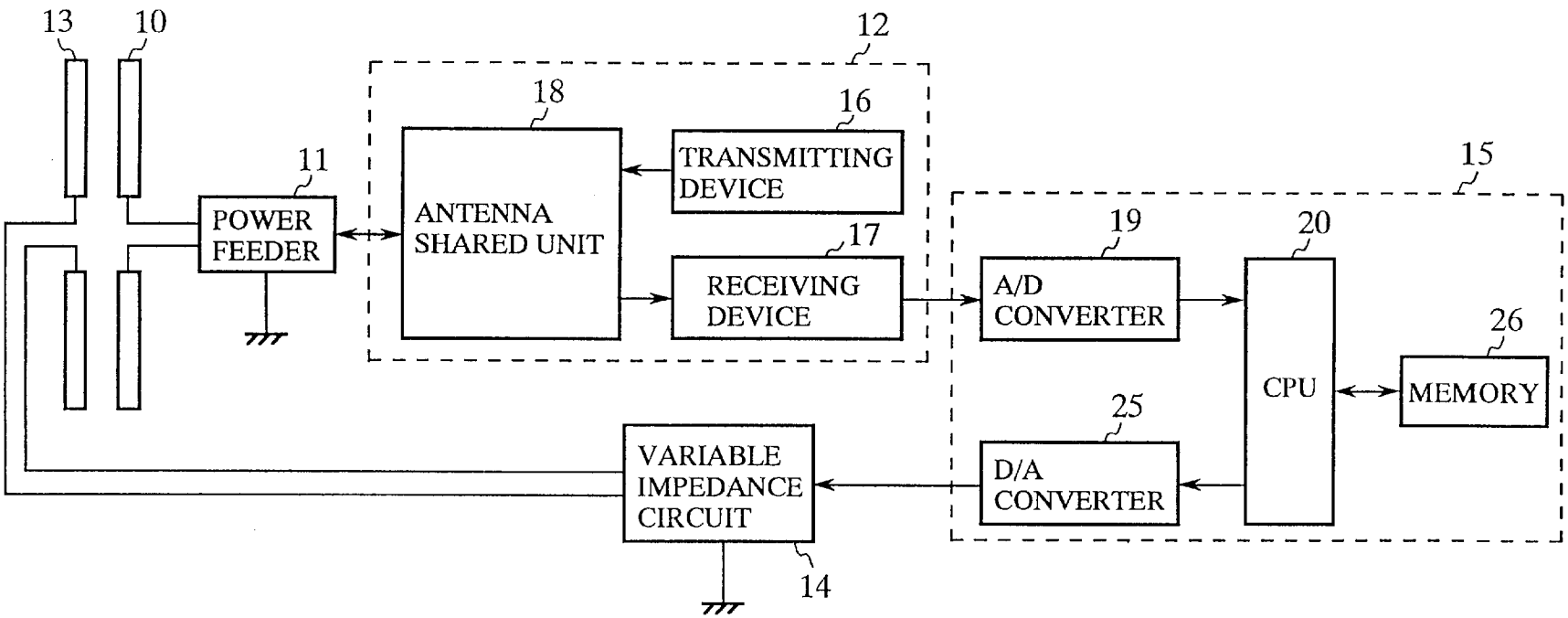
Figure 2:
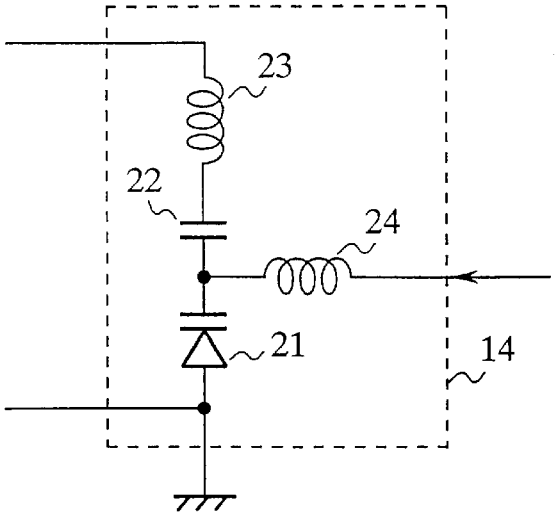

FIG. 1 is a block diagram showing one example of a variable directional antenna apparatus of the present invention. Reference numeral 10 represents a first antenna, 11 is a power feeder, 12 is a radio device, 13 is a second antenna, 14 is a variable impedance circuit and 15 is a control circuit. The first antenna 10 is a dipole antenna having an electrical length of $\lambda/2$ which resonates at a used frequency and formed by two bar-like conductors. Further, the first antenna 10 is electrically connected to the radio apparatus 12 through the power feeder 11. The radio apparatus 12 comprises a transmitting device 16, a receiving device 17, and an antenna shared unit 18 provided to share the use of the antennas during transmission and reception. The first antenna 10 is electrically connected to the transmitting device 16 and the receiving device 17 through the power feeder 11 and the antenna shared unit 18. The receiving device 17 outputs a voltage corresponding to received field strength or intensity and is electrically connected to an A/D converter 19 provided within the control circuit 15, The output of the A/D converter 19 is connected to a CPU 20. The second antenna 13 has also the structure of a dipole antenna formed by two bar-like conductors. Further, the second antenna 13 is placed in parallel at a little distance away from the first antenna 10 and electrically connected to the variable impedance circuit 14. As shown in FIG. 2, the variable impedance circuit 14 comprises a variable capacitance diode 21 whose capacitance value varies according to the voltage applied thereto, a capacitor 22 for cutting a d.c.

voltage, a coil 23 for canceling out the capacitive property or capacitiveness of the variable capacitance diode 21, and a high-frequency choke coil 24 for cutting a high-frequency component. The second antenna 13 is electrically connected in series to the coil 23, capacitor 22 and variable capacitance diode 21 and electrically connected via the high-frequency choke coil 24 to the output side of a D/A converter 25 provided within the control circuit 15. The input side of the D/A converter 25 is electrically connected to the CPU 20. Further, the CPU 20 is electrically connected to a memory 26.

Figure 3:
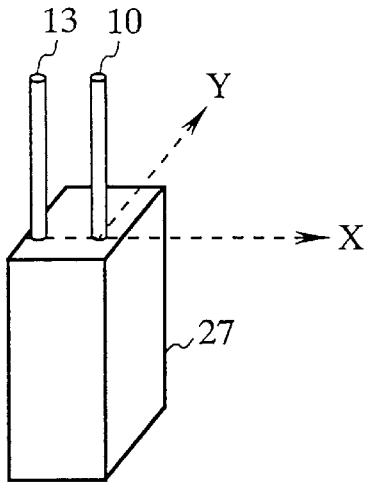

FIG. 3 is a conceptional view showing the state in which the variable directional antenna apparatus of the present invention is mounted on a housing or body 27 of a radio apparatus. In FIG. 3, the first antenna 10 and the second antenna 13 are placed on and fixed to the upper surface of the body 27 in parallel at a little distance away from each other in the X-axis direction and in the direction which varies their directivity in such a manner so that their directivity varies along the X-axis direction. Further, the power feeder 11, radio device 12, variable impedance circuit 14 and control circuit 15 are incorporated into the body 27.

The first antenna 10 and the second antenna 13 are disposed in parallel at a distance equivalent to 0.2 to 1.0 times $\lambda/4$ away from each other. However, when the conductors approach each other, a capacitance and a mutual impedance produced between the conductors exist in addition to the capacitance and self-inductance of the respective conductors. Antennas used at high frequencies cannot ignore such impedances. Therefore, the interval between the first antenna 10 and the second antenna 13 and the thicknesses of the conductors for the antennas are respectively actually varied so that both antennas operate optimally as a two-element Yagi antenna. Therefore the impedance of one conductor is matched to that of the other conductor to thereby determine the impedances.

Figure 4:
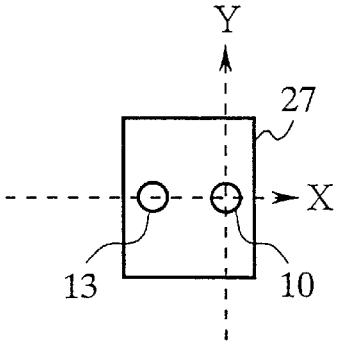
Figure 4:
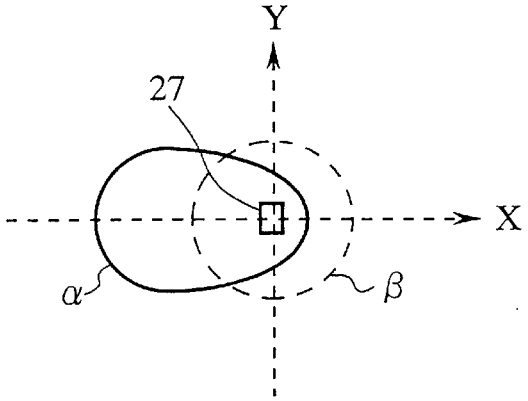
Figure 5:
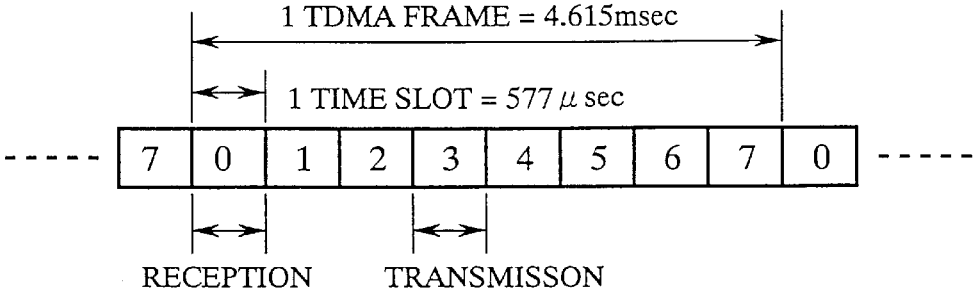

The second antenna 13 is electrically connected in series with the coil 23, capacitor 22 and variable capacitance diode 21. When the voltage applied across the variable capacitance diode 21 is low, the electrical length of the second antenna becomes shorter than the original electrical length due to the capacitiveness or capacitive property of the variable capacitance diode 21. Since the capacitiveness of the variable capacitance diode 21 is reduced as the voltage increases, the electrical length of the second antenna 13 becomes longer. Thus, the physical length of the second antenna 13 and a variable range of the capacitance of the variable capacitance diode 21 are set in such a manner that when the voltage of the D/A converter 25 is low, the electrical length of the second antenna 13 is slightly shorter than $\lambda/2$ (about 0.9 times) and when the output voltage of the D/A converter 25 is high, the electrical length of the second antenna 13 is slightly longer than $\lambda/2$ (about 1.1 times). In doing so, the second antenna 13 operates as a director when the output voltage of the D/A converter 25 is low (the output voltage of the D/A converter 25 at this time is defined as V1), whereas when the output voltage thereof is high (the output voltage of the D/A converter 25 is defined as V2), the second antenna 13 operates as a reflector. In practice, the physical length of the second antenna 13 and the variable range of the variable capacitance diode 21 are determined experimentally while the interval between the first antenna 10 and the second antenna 13 and their respective lengths are being varied so that the second antenna 13 serving as the two-element Yagi antenna is suitably activated as a reflector and director. FIG. 4(*a*) illustrates the radio apparatus body 27 shown in FIG. 3 as seen from the upper surface thereof. An ellipse indicated by a solid line in FIG. 4(*b*) shows one example of a radiation directional pattern given on the X-Y plane when the second antenna 13 is activated as a director. Here, a circle β indicated by a broken line in FIG. 4(*b*) exhibits radiation directivity of the dipole antenna. It is well known that it results in a non-directional circle on the X-Y plane. Further, it is often used as the reference for a radiation characteristic. As is understood from FIG. 4(*b*), when the second antenna 13 is activated as the director, a strong radiation field is obtained on the second antenna 13 side along the X-axis direction and a radiation field on the first antenna 10 side is restricted. On the hand, when the second antenna 13 is activated as the reflector (not shown), it exhibits a characteristic opposite to that of the director and hence a strong radiation field is obtained on the first antenna 10 side. Since the magnitude of the radiation field varies according to the electrical length of the second antenna 13 and the distance between the first antenna 10 and the second antenna 13, lengths and distances may be selected so that a desired directional pattern is obtained. Further, the coil 23 is used to cancel out the capacitive properties of the capacitor 22 and the variable capacitance diode 21 and shorten the physical length of the second antenna 13. Data D1 and D2 corresponding to the output voltages V1 and V2 of the D/A converter 25 at the time the second antenna 13 is activated as a director and reflector, are stored in the memory 26 as specified values in advance.

The TDMA method will next be explained briefly. FIG. is an explanatory view showing one TDMA frame configuration during a GSM call under the pan-European method. In the GSM, one TDMA frame (4.615 mS) is divided by eight and made up of eight time slots (one time slot=577 $\mu$S) of 0 to 7. During a call, a basic periodic pattern is formed in which operations for reception (0th slot) and transmission (3rd slot) are respectively performed by one slot in one frame. The remaining 6 slots are ones having no bearing on calls, which are called "available" or "free" slots. The mobile unit normally monitors the field intensity of a base station adjacent thereto through the free slots. Thereupon, the mobile unit varies the directivity of the antenna at 7th slots immediately before the remaining free slots, e.g., the reception slots to thereby measure their received field intensities. The mobile unit controls each antenna so as to obtain antenna directivity in which received field intensities are large at reception/transmission slots in the next frame.

Figure 6:
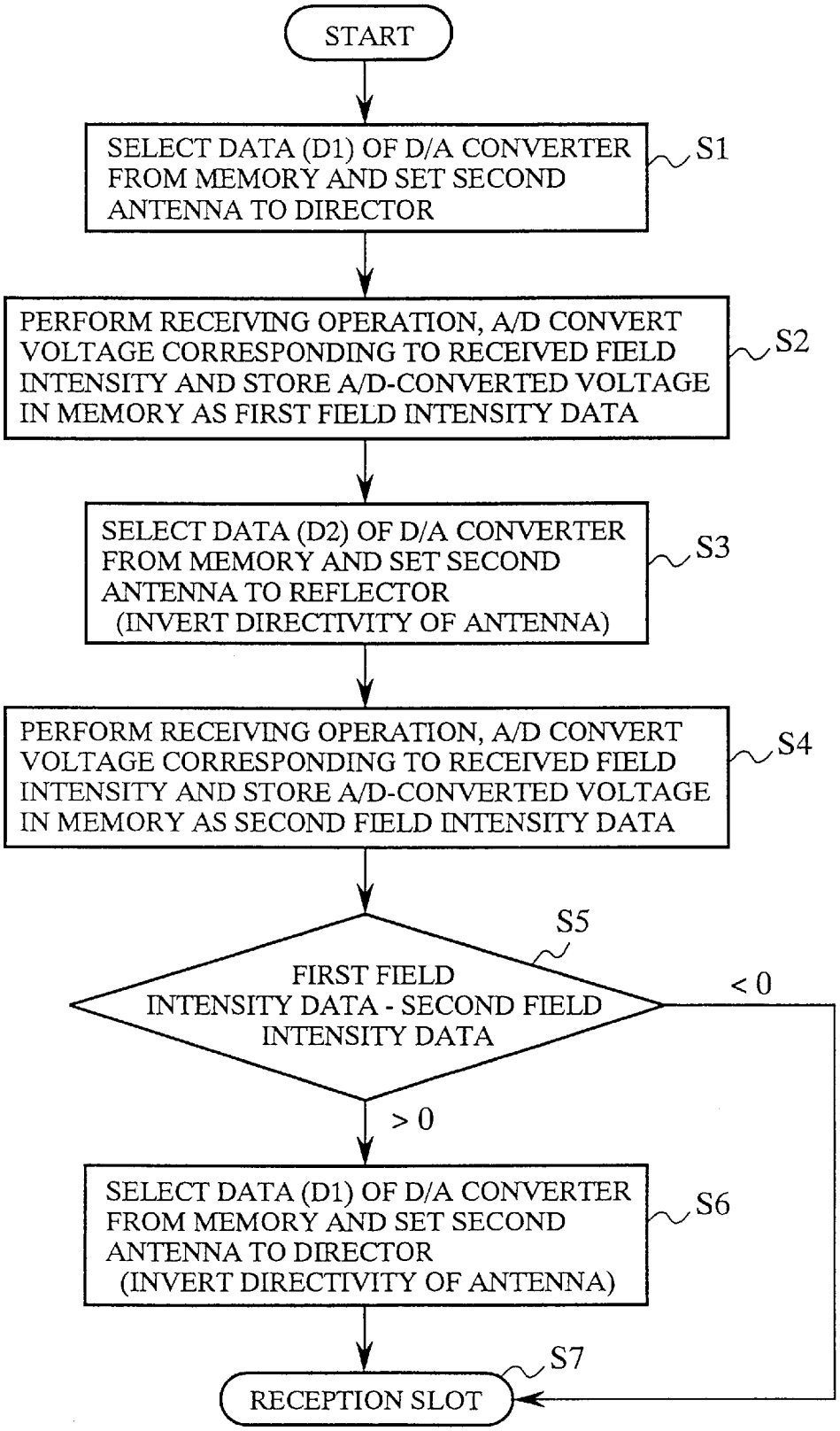

FIG. 6 is a flowchart for describing a method of controlling a variable directional antenna. During any available slot (e.g., 7th slot) from the completion of a transmission slot to the start of a reception slot in the next frame, the CPU 20 first selects the data (D1) stored in the memory 26 so that the second antenna 13 operates as the director, thereby controlling the output voltage of the D/A converter 25 (Step S1). At that time, a radio wave received by the first antenna 10 is inputted to the receiving device 17 through the power feeder 11 and the antenna shared unit 18. The receiving device 17 outputs a voltage corresponding to the received field intensity and the A/D converter 19 performs A/D conversion on the voltage, after which it is brought into the CPU 20. The data (first field intensity data) captured by the CPU 20 is temporarily stored in the memory 26 (Step S2). Next, the CPU 20 selects the data (D2) stored in the memory 26 so that the second antenna 13 acts as the reflector, thereby controlling the output voltage of the D/A converter 25 so as to invert antenna directivity (Step S3) (antenna directivity may be selected in reverse order of the reflector to the director). Similarly, a voltage corresponding to field intensity at that time is A/D-converted and thereafter captured by the CPU 20. The captured data (second field intensity data) is stored in the memory 26 (Step S4). The CPU 20 compares the first field intensity data and the second field intensity data. When the first field intensity data is larger than the second field intensity data (when the first field intensity data−the second field intensity data>0) (Step S5), the CPU 20 sets the output voltage of the D/A converter 25 so that the second antenna 13 acts as the director (Step S6). On the other hand, when the second field intensity data is greater than the first field intensity data (when the first field intensity data−the second field intensity data<0), the CPU 20 sets the output voltage of the D/A converter 25 so that the second antenna 13 acts as the reflector. Thus, directivity of a higher field intensity is obtained between the reception slot and the transmission slot in the next frame (Step S7). Similarly, these controls are repeatedly performed every frame.

Figure 7A:
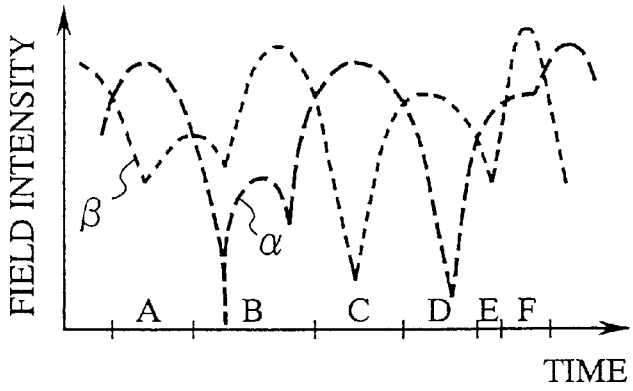
FIGS. 7A and 7B are diagram for describing field intensity produced in the variable directional antenna apparatus of the present invention.
Figure 7B:
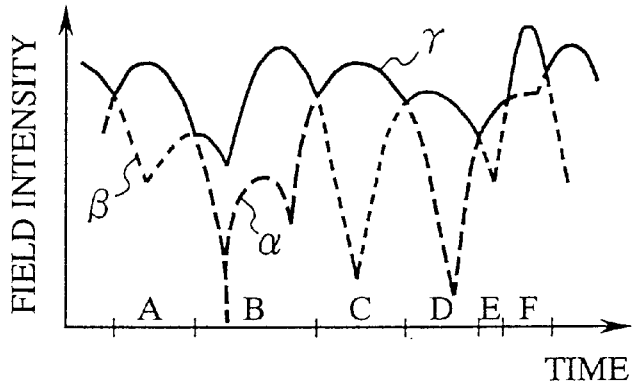

FIG. 7(*a*) is a diagram for describing field intensities of the variable directional antenna apparatus of the present invention. The horizontal axis is defined as time and the vertical axis is defined as the field intensity. For example, a broken line α will be defined as a field intensity distribution obtained when the second antenna 13 is activated as the director, and a dotted line β will be defined as a field intensity distribution obtained when the second antenna 13 is operated as the reflector. In a range of a time A, the field intensity obtained when the second antenna 13 is activated as the director, is greater than that obtained when activated as the reflector. In a range of a time B, the field intensity obtained when the second antenna 13 is operated as the reflector in reverse, is greater than that when activated as the director. Therefore, the control shown in FIG. 6 is carried out to successively perform switching to directivities having large field intensities as in the case where the second antenna 13 is activated as the director in the time A range, the reflector in a time B range and the director in a time C range respectively. Thus, a field intensity distribution is obtained as indicated by a solid line γ shown in FIG. 7(*b*).

In the variable directional antenna apparatus of the present invention as described above, a paired two-element Yagi antenna is made up of the first antenna 10 an the second antenna 13. To this added the variable impedance circuit 14, the radio apparatus 16 and the control circuit 15 which provide a simple configuration. Owing to this, the CPU 20 controls the variable impedance circuit 14 so that the field intensity increases, while monitoring the field intensity and changes or switches the second antenna 13 used as a parasitic antenna so as to operate as either the director or the reflector as needed, thereby selectively changing its directivity. Therefore, even if the field intensity distribution is suddenly reduced due to the influence of a reflected wave as indicated by the dotted line α or the broken line β in FIG. 7(*a*), an abrupt drop in the field strength can be reduced as indicated by the solid line γ in FIG. 7(*b*). Since the variable impedance circuit 14 is made up of the variable diode 21, capacitor 22, coil 23 and high-frequency choke coil 24, and the second antenna 13 is loaded in series with even the coil 23 as well as with the variable capacitance diode 21 and the capacitor 22 The capacitive components: the variable capacitance diode 21 and capacitor 22 can be canceled out by the coil 23. Therefore, since the physical length of the second antenna 13 can be arbitrarily set by selecting the value of the coil 23, the second antenna 13 can be formed by a small-sized antenna. Further, since the control circuit 15 comprises the A/D converter 19, CPU 20, memory 26 and D/A converter $^{2}$5, the received field intensity can be monitored with satisfactory accuracy by the A/D converter 19. Moreover, since the voltage is applied across the variable capacitance diode 21 by the D/A converter 25 controlled by the CPU 20, desired directivity can be obtained with satisfactory accuracy. Namely, owing to the simple electrical control of the directivity of the two-element Yagi antenna as needed, an effect as good as or better than that obtained by the various conventional diversity or conventional variable directional antenna can be obtained in a simpler and inexpensive configuration and by a small-sized form convenient for carrying. Since the output of the D/A converter 25 and the variable capacitance diode 21 are electrically connected to each other through the high-frequency choke coil 24 used as a high-frequency inhibiting means, there is no possibility that a high-frequency component will interact with the control circuit 15, thereby producing noise. Even when a resistor is used in place of the high-frequency coil, a similar effect can be obtained. Since no control is effected on the first antenna 10 used as a feed antenna, switching noise or the like during control does not occur. The received electric field has mainly been described in the present embodiment. However, since a transmit wave propagates through the same path as a receive wave, an effect similar even to a transmitted radiation field can be obtained at a receiving position of the opposite party by changing the antenna directivity so that the intensity of the received electric field is increased. Namely, the variable directional antenna apparatus according to the present invention may be mounted on either one of a pair of radio apparatuses. Further, its configuration as a system can be greatly simplified as compared with the conventional space diversity reception system. Although the present embodiment has described the variable directional antenna apparatus as applied to a radio apparatus in the TDMA method, the variable directional antenna apparatus of the present invention is applicable to a system of another method by changing its control method or control timing.

<Control of directivity of antenna by obstacle sensor>

The aforementioned variable directional antenna apparatus has monitored the received field intensity and thereby determined the directivity. In a radio apparatus such as a portable telephone or the like, however, a speaker and a microphone are incorporated into the body of the radio apparatus and the body thereof is used during a call by being held to the ear. The antenna is generally mounted to the upper portion of the radio apparatus and hence the head and face of a person using the radio apparatus serve as obstacles to the call. Hence a radiation (incident) field in the head direction might be weak. Therefore, a sensor for detecting obstacles is provided on the speaker side of the body thereof in place of the monitoring of the received field intensity. When the body thereof is near the face during a call, the directivity is set so as to be directed in the direction opposite to the face.

Figure 8:
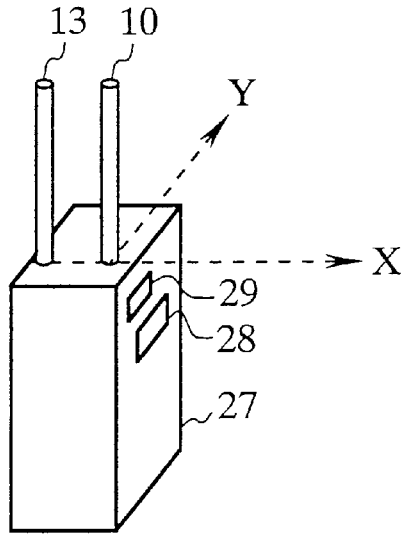
Figure 9:
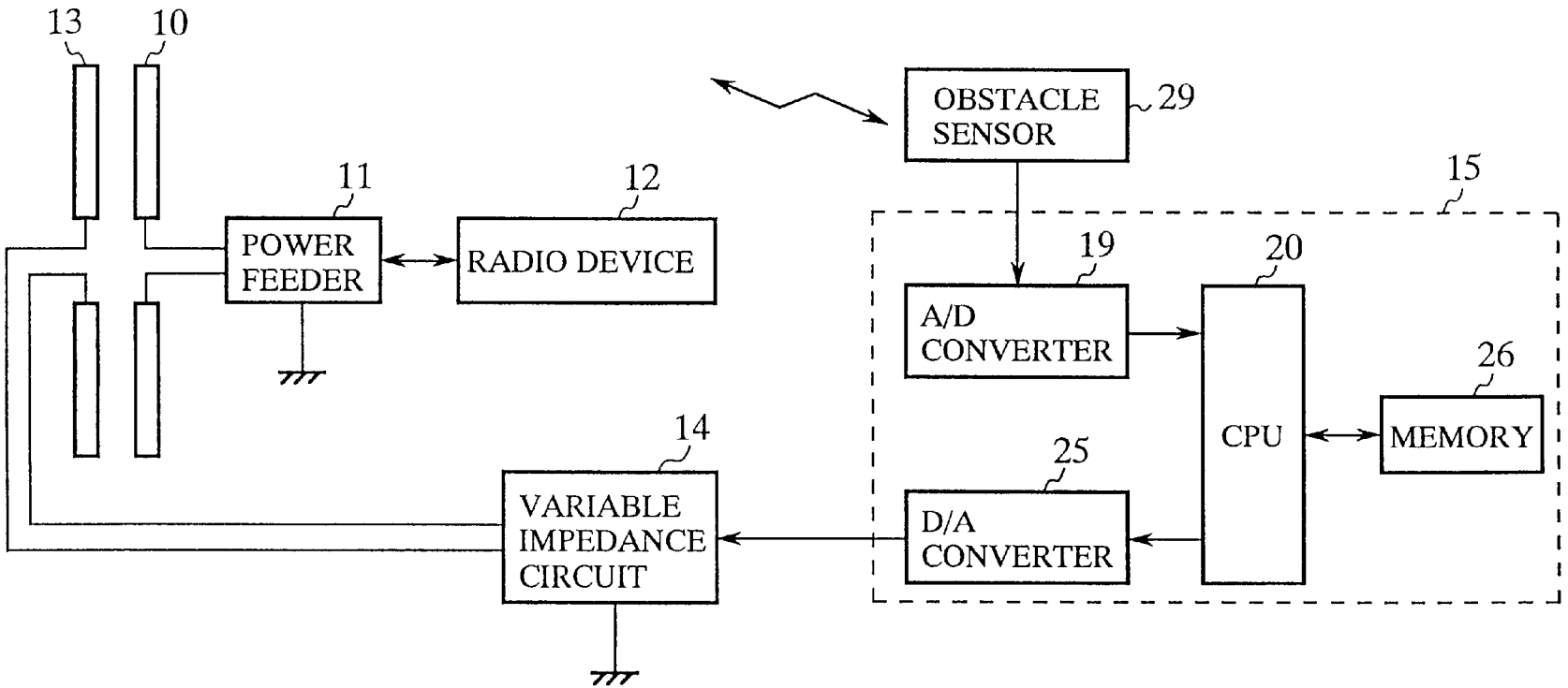

FIG. 8 is a perspective view of a radio apparatus provided with a variable directional antenna apparatus for controlling the directivity of each antenna through an obstacle sensor. In the drawing, the same reference numerals as those shown in FIG. 3 indicate the same or corresponding portions respectively. Reference numeral 28 indicates a speaker provided on the arrow side of an X axis of a body 27 and reference numeral 29 indicates an obstacle sensor provided near the speaker 28. FIG. 9 is a block diagram showing the variable directional antenna apparatus incorporated into the radio apparatus shown in FIG. 8. The variable directional antenna apparatus comprises a first antenna 10, a second antenna 13, a power feeder 11, a radio device 12, a control circuit 26, a variable impedance circuit 14 and an obstacle sensor 29. Since the present variable directional antenna apparatus is identical in most configurations to that shown in FIG. 1, the description of the operation other than that of the obstacle sensor 29 will be omitted. The obstacle sensor 29 uses an obstacle sensor such as an infrared ray sensor or the like. For example, when an obstacle such as the face of a person, or the like approaches the speaker 28 side of the body of the radio apparatus, the obstacle sensor 29 outputs an electric signal (voltage) corresponding to the distance between the two. The electric signal is inputted to an A/D converter 19 and subjected to A/D conversion. Thereafter, the converted signal is captured by a CPU 20. The CPU 20 compares the signal with data stored in the memory 26. When the signal reaches a predetermined level, the CPU 20 determines that an obstacle exists and controls a D/A converter 25 so that directivity is turned in the direction opposite to that of the obstacle, thereby varying an electrical length of the second antenna 13. Namely, supposing that an obstacle exists in the X-axis direction indicated by the arrow (on the first antenna 10 side) in FIG. 8, the CPU 20 controls the directivity like the solid line α in FIG. 4(*b*) so as to take the direction opposite to that of the obstacle. Since the obstacle exists on the first antenna 10 side in this case, the CPU 20 may control the second antenna 13 so that it acts as a director. When the first antenna 10 and the second antenna 13 are positioned in reverse order (when an obstacle exists on the second antenna 13 side), the CPU 20 may the second antenna 13 so as to act as a reflector.

The variable directional antenna apparatus shown in FIG. 9 comprises the first antenna 10, second antenna 13, power feeder 11, radio device 12, control circuit 26, variable impedance circuit 14 and obstacle sensor 29. When the obstacle approaches the variable directional antenna apparatus, the obstacle sensor 29 outputs an electric signal and the CPU 20 controls the directivity so as to be in the direction opposite to that of the obstacle. It is therefore possible to prevent the field intensity beforehand from being weakened due to obstacles such as the head and face of the person upon a call. Since there is almost no incident radiation on the obstacle side at this time, the electric field can be transmitted and received with efficiency.

Figure 10:
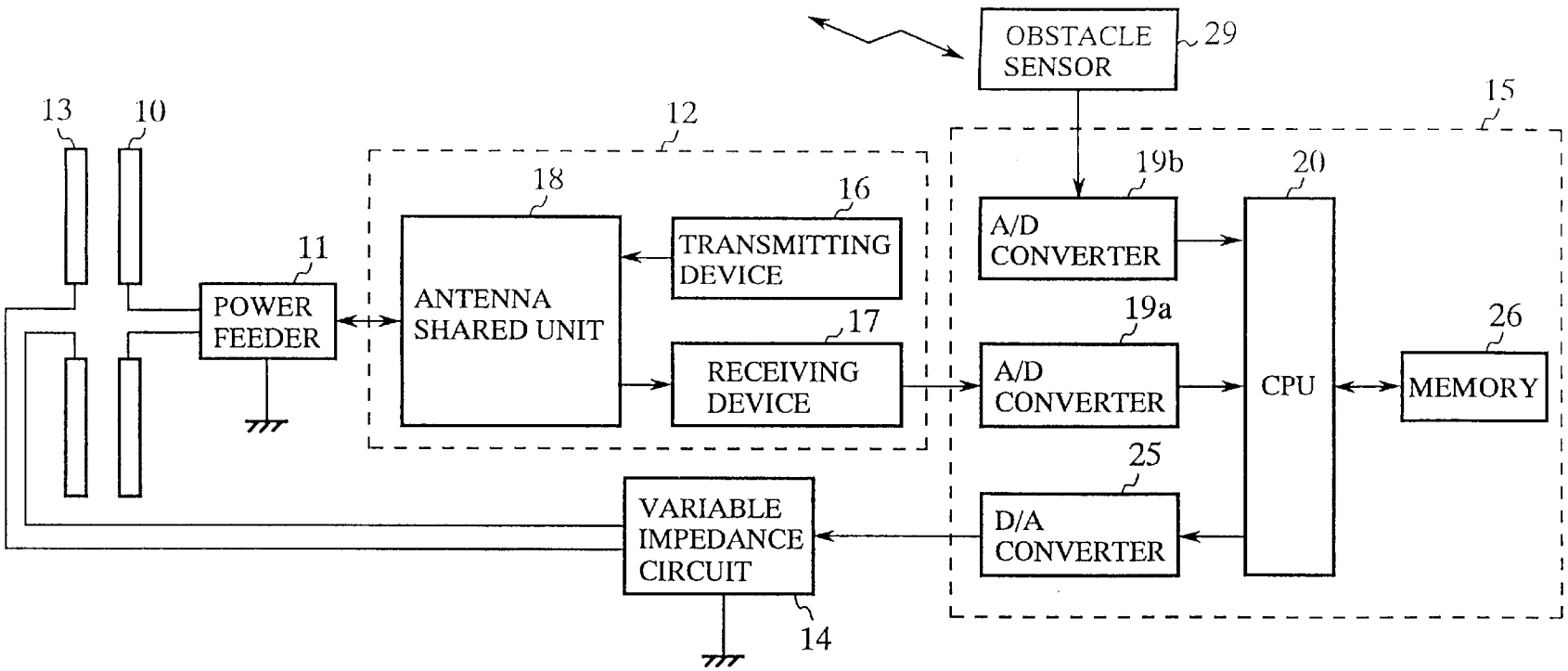

The antenna directivity may be controlled by utilizing the method of monitoring the electric field to thereby control the antenna directivity as in the variable directional antenna apparatus shown in FIG. 1 This may be used in combination with the method of controlling the directivity by the obstacle sensor as in the variable directional antenna apparatus shown in FIG. 9. FIG. 10 is a block diagram showing a configuration of a variable directional antenna apparatus which performs such control. In the drawing, the same reference numerals as those in FIG. 9 indicate the same or corresponding portions respectively. In FIG. 10, reference numeral 19(*a*) indicates an A/D converter for monitoring the intensity of an electric field, and reference numeral 19(*b*) indicates an obstacle sensing A/D converter 19(*b*) for inputting a sensed signal from an obstacle sensor 29. If a radio apparatus such as a portable telephone or the like controls the directivity of each antenna while monitoring the field intensity as in the variable directional antenna apparatus shown in FIG. 1, when it waits for an incoming call (hereinafter "while waiting"), and if when a call is made, it controls the directivity of the antenna through an obstacle sensor 29 as in the variable directional antenna apparatus shown in FIG. 9, then the optimum directivity can be obtained while waiting and during a call.

If the antenna directivity can be determined in advance where the body of the radio apparatus is used while being always placed against the face upon the call, then the variable impedance circuit may be controlled without having to use the obstacle sensor or the like so that the antenna directivity is always pointed in the direction opposite to that of the obstacle on the speaker side while a call is in progress. In this case, the corresponding configuration can be made simpler.

<Variable directional antenna apparatus using grounded antennas>

Figure 11:
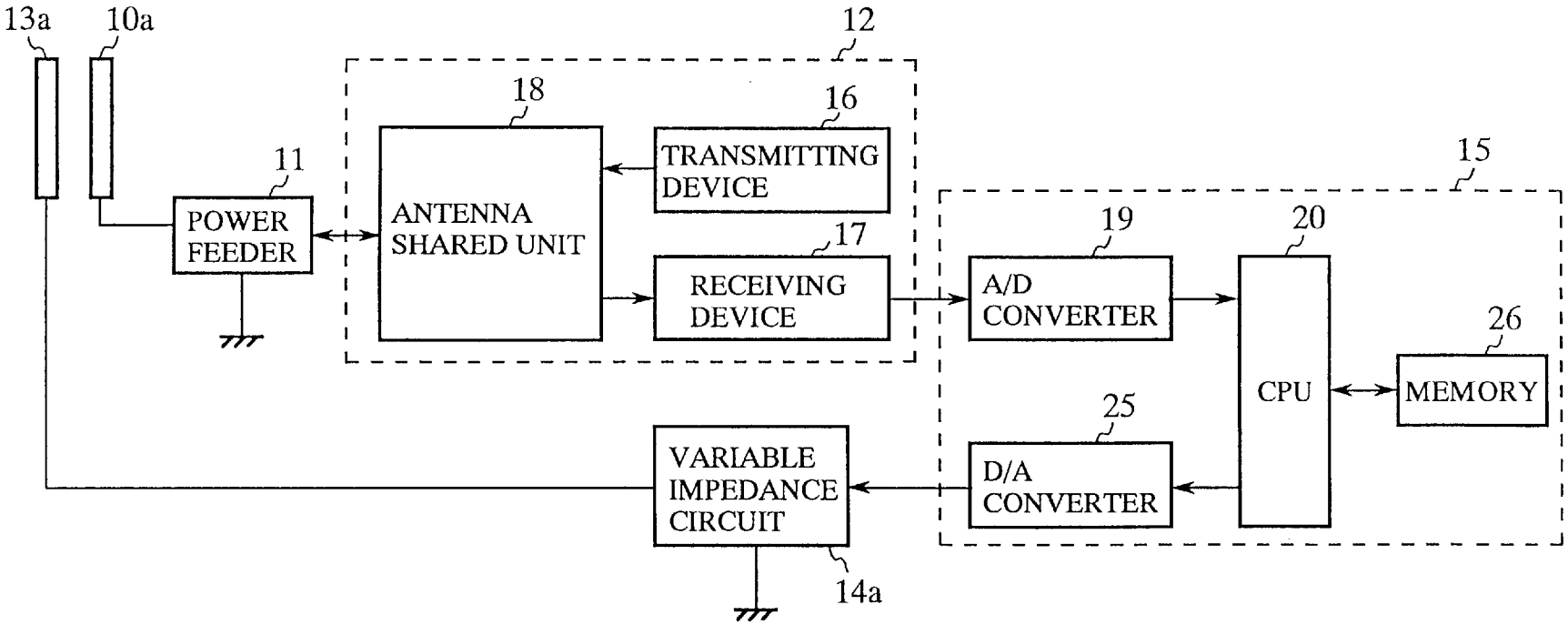
Figure 12:
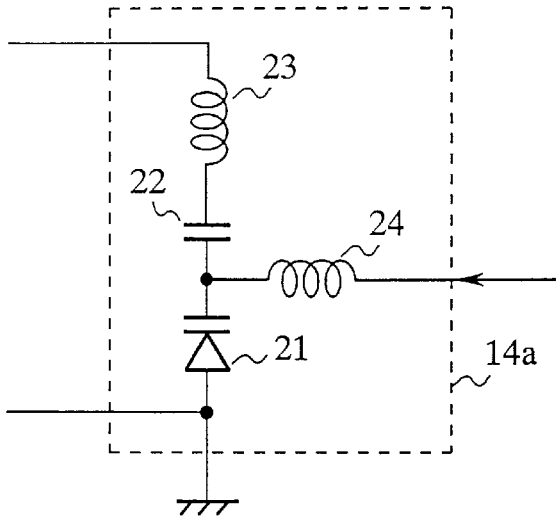

In the variable directional antenna apparatus shown in FIG. 1, the first antenna 10 is formed by the dipole antenna of λ/2 which resonates at the used frequency. However, the first antenna 10 may be formed by a grounded antenna. FIG. 11 is a block diagram showing a configuration of a variable directional antenna apparatus using grounded antennas according to the present invention. The same reference numerals as those in FIG. 1 indicate the same or corresponding portions respectively. In FIG. 11, reference numerals 10*a*, 13*a* and 14*a* indicate a first antenna, a second antenna and a variable impedance circuit respectively. The first antenna 10*a* is a grounded antenna comprised of one conductor having an electrical length in the range of 5λ/8 to λ/4, which resonates at a used frequency and is electrically connected to a power feeder 11. The second antenna 13*a* is a grounded antenna similar to the first antenna 10*a*. The second antenna 13*a* is placed spaced a little away from the first antenna 10*a* and is electrically connected to the variable impedance circuit 14*a*. The variable impedance circuit 14*a* comprises a variable capacitance diode 21, a capacitor 22, a coil 23 and a high-frequency choke coil 24 as shown in FIG. 12. The variable directional antenna apparatus is identical to the variable directional antenna apparatus shown in FIG. 1 as regards other configurations, operations and control methods. Needless to say, the variable directional antenna apparatus shown in FIG. 11 can be applied to the variable directional antenna apparatus shown in FIG. 9.

As the first antenna 10*a* and the second antenna 13*a* of the variable directional antenna apparatus by the grounded antennas are formed as describe d above, the physical lengths of the antennas can be set to about one-half the lengths of the λ/2 dipole antennas, respectively. Further, the variable directional antenna apparatus results in a structure of less size and weight and convenient for carrying.

<Formation of antenna elements by coil-shaped conductors and bent conductors>

Figure 13:
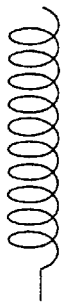
Figure 13:
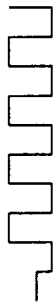

Although the aforementioned first antennas 10 and 10*a* (hereinafter generically called "first antenna 10") and the second antennas 13 and 13*a* (hereinafter generically called "second antenna 13") have been formed by bar-like conductors respectively They may be made of coil-shaped conductors and bent conductors formed by bending conductors. FIG. 13(*a*) is a diagram for describing an antenna obtained by forming both the first antenna 10 and the second antenna 13 using a coil-shaped conductor having an electrical length of λ/4, for example. FIG. 13(*b*) is a diagram for describing an antenna obtained by forming each antenna by a bent conductor having an electrical length of λ/4 in same manner as described above.

Thus, the formation of the respective antenna elements by the coil-shaped conductors or bent conductors allows a further reduction in the physical length of the antennas and can allow each antenna to have small size and be convenient for carrying.

<Formation of antenna elements by mounting metal conductors on insulating substrate>

Figure 14:
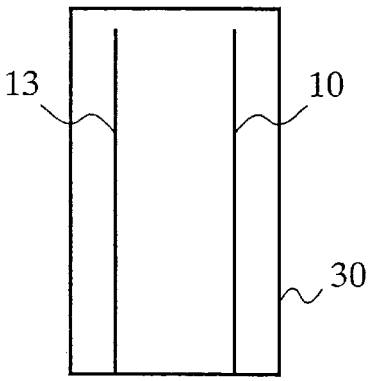

Further, the first antenna 10 and the second antenna 13 may be formed by affixing metal conductors to an insulating substrate. FIG. 14 is a diagram for describing antenna elements formed by mounting metal conductors on an insulating substrate. In FIG. 14, the respective metal conductors for the first antenna 10 and the second antenna 13 are respectively grounded antennas each having an electrical length of λ/4, for example and mounted and formed on an insulating substrate 30 in parallel at a small distance away from each other. A lower end of the conductor for the first antenna 10 is electrically connected to the power feeder 11 as shown in FIG. 11. A lower end of the conductor for the second antenna 13 is also electrically connected to the variable impedance circuit 14*a* in a manner similar to FIG. 11.

Since the conductors for the respective antennas are mounted and formed on the insulating substrate 30 as described above, the antenna elements can be formed with high dimensional accuracy by a micro-fabrication technique such as etching machining or the like. Further, since they are rugged, stable characteristics can be obtained.

Figure 15:
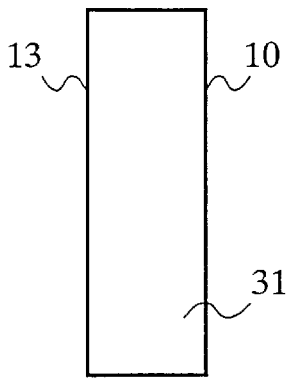

The conductors for the respective antennas may be formed on both ends of a thick insulating material or body without being formed on the insulating substrate 30. FIG. 15 is a diagram for describing antenna elements formed by mounting metal conductors. In FIG. 15, the conductors for the first antenna 10 and the second antenna 13 are respectively formed at both ends of an insulating body 31. Here, since the thickness of the insulating body 31 is equivalent to the interval between the first antenna 10 and the second antenna 13, it is set so as to take 0.2 to 1.0 times of λ/4 as in the variable directional antenna apparatus shown in FIG. 1.

Further, the conductors for the respective antennas are shaped in film form and may be bonded or affixed to a glass plate used for an automobile or the like or inserted into the glass plate.

When dielectrics with a high dielectric constant are used for the insulating substrate 30 and the insulating body 31, the physical lengths of the respective antennas can be shortened due to the dielectric constants of the dielectrics, and the interval between the respective antennas can be shortened. Therefore, the antenna elements can be used in shapes smaller in size and suitable for carrying.

Further, the shapes of the antenna elements mounted and formed on the insulating substrate 30 and the insulating body 31 respectively may be formed by the bent conductor shown in FIG. 13(*b*). In this case, each antenna element may be used in a shape smaller in size and suitable for carrying.

<Storage of antenna elements in body for radio apparatus>

Although the first antenna 10 and the second antenna 13 are fixedly placed on the upper surface of the radio apparatus body 27 in FIG. 3, the respective antennas may be shaped into structures storable so as to be easy to carry respectively. FIG. 16 is an explanatory view of a state in which a first antenna 10 and a second antenna 13 are mounted on the upper surface of a radio apparatus body 27, in which FIG. 16(*a*) shows the respective antennas as extended, and FIG. 16(*b*) illustrates the antennas as stored in the body 27 except for portions of the respective antennas. When the antennas are extended from and stored in the body 27, portions which project from the body 27, operate as the antennas. FIG. 17 is a side view of FIG. 16. In an antenna in an extended state as shown in FIG. 17(*a*), the first antenna 10 is electrically connected to the power feeder 11 shown in FIG. 11 at a chain-line point S inside the cabinet. Similarly, the second antenna 13 is electrically connected to the variable impedance circuit 14*a* shown in FIG. 11. Since the portions of the first antenna 10 and second antenna 13 shown in FIG. 17(*a*), which protrude from the cabinet 27, operate the antennas, the electrical lengths of the protruded portions are set so as to range from λ3/8 to λ/2. In an antenna stored state shown in FIG. 17(*b*), the first antenna 10 is electrically connected to the power feeder 11 shown in FIG. 11 at a chain-line point S inside the body 27. Similarly, the second antenna 13 is electrically connected to the variable impedance circuit 14*a* shown in FIG. 11. Even in this case, since the portions of the first antenna 10 and second antenna 13 shown in FIG. 17(*b*), which protrude from the body 27, are activated as antennas, the electrical lengths of the protruded portions are set so as to reach λ/4. Further, the impedance of each stored portion as viewed from the power feeder (the chain-line point S in FIG. 17(*b*)) is set so as to reach infinity so that each stored portion indicated by the dotted line is not activated as the antenna. FIG. 18 illustrates examples of grounded antennas, wherein FIG. 18(*a*) shows an antenna element formed by a coil-shaped conductor, and FIG. 18(*b*) shows an antenna element formed by a bent conductor. A portion L1, which protrudes when the antenna element is held, is comprised of a coil-shaped conductor and a bent conductor so that its physical length becomes short, whereas a stored portion L2 is made up of a bar-like conductor. The electrical length of the portion L1 is set to λ/4 and the electrical length of the portion L3 is set to a range from λ3/8 to λ/2. Thus, since the portion L3 acts as an antenna when the antenna is extended, and the portion L1 is activated as the antenna when it is held, transmission and reception can be performed upon both the extension and storage of each antenna. Since the physical length of the antenna is long upon its extension, the influence of obstacles such as the head and face of a person, etc. can be lessened. Since the physical lengths of the protruded portions are short upon their storage, they are suitable for carrying.

Figure 19:
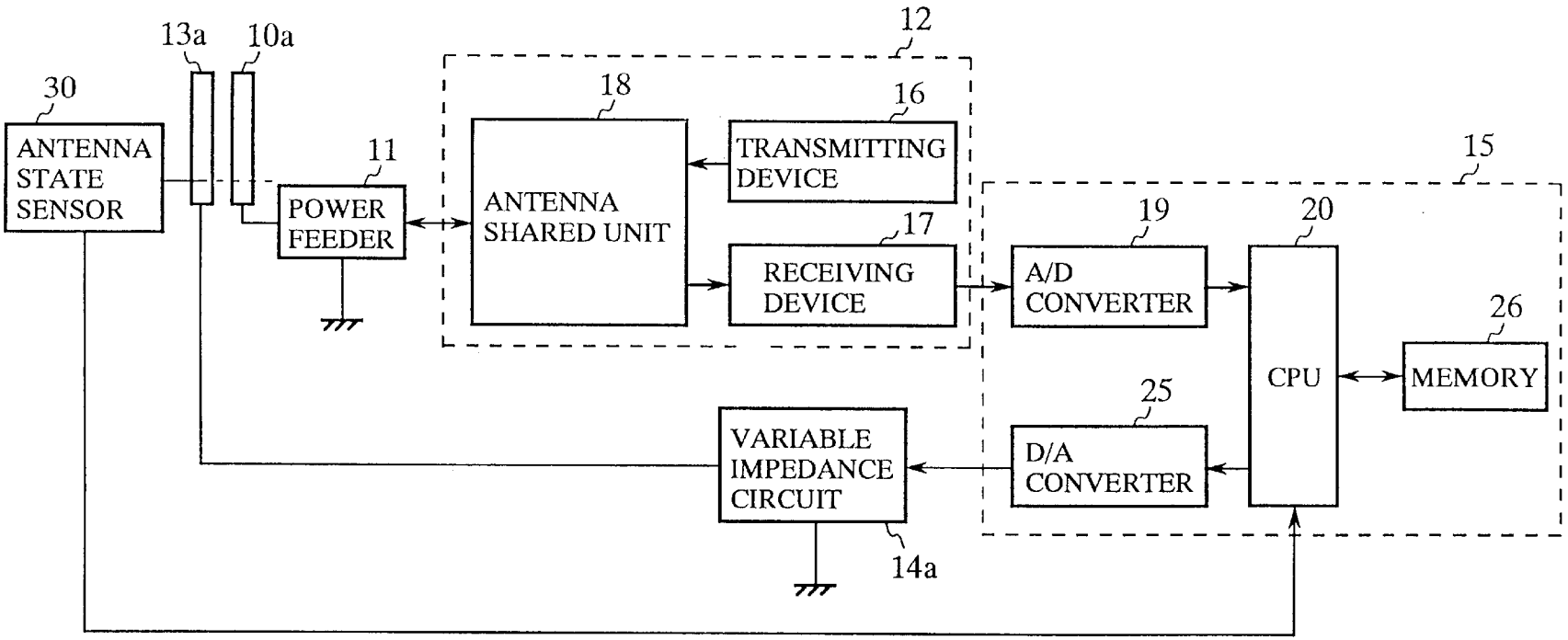
Figure 20:
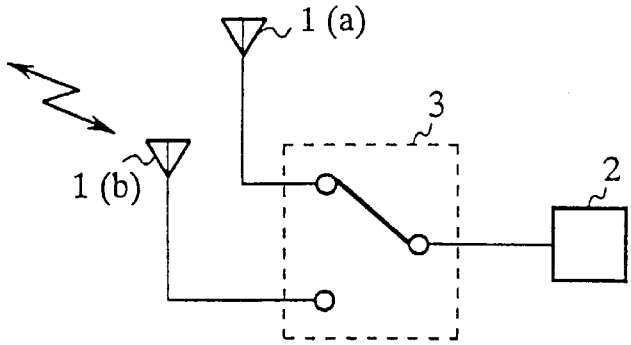
FIG.20 (PRIOR ART)
FIG. 20 is a diagram for describing conventional spatial diversity.
Figure 21:
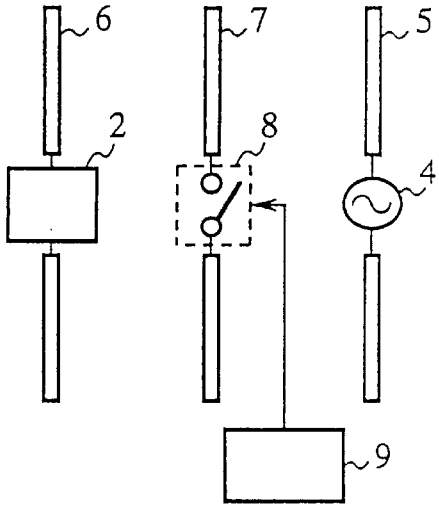
FIG.21 (PRIOR ART)
FIG. 21 is a block diagram illustrating a conventional variable directional antenna.
Figures 22A, 22B:
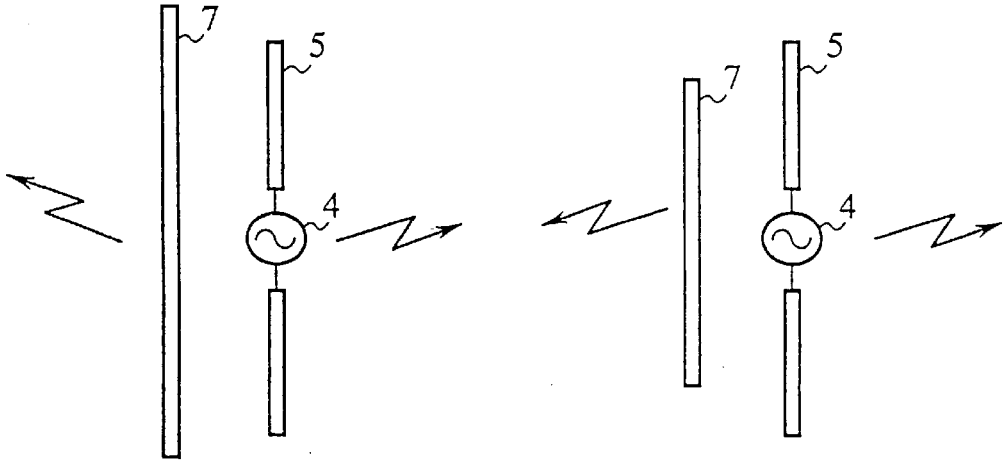
FIG.22(a) (PRIOR ART) FIG.22(b) (PRIOR ART)
FIGS. 22A and 22B are diagram showing the principle of a two-element Yagi antenna.

Since the two states of the extension and storage of the antennas exist, the set value of the D/A converter 25 is stored in the memory 26 so that the second antenna is suitably activated as the director or reflector according to the respective states. FIG. 19 is a block diagram showing a variable directional antenna apparatus provided with an antenna state sensor. Reference numeral 30 indicates an antenna state sensor for detecting whether each antenna is extended or stored. The antenna state sensor 30 monitors the state of each antenna and outputs a signal corresponding to the extension and storage of the antenna to a CPU 20. The CPU 20 selects data required to activate a second antenna 13*a* as a reflector or a director from a memory 26 according to the extension and storage of each antenna to control a variable impedance circuit 14*a* through a D/A converter 25, thereby activating the second antenna 13*a* as the reflector or director upon the extension and storage and performing control similar to FIG. 6 in the respective states of the extension and storage. By doing so, the optimum directivity of each antenna can be obtained upon its extension regardless of its storage.

<Another form of control on variable impedance circuit>

In the aforementioned variable directional antenna apparatus, the impedance of each of the variable impedance circuits 14 and 14*a* is varied by the D/A converter 25 controlled by the CPU 20 so as to activate the second antenna 10 as the director or reflector. However, a port of the CPU 20, for outputting a Low/High voltage may be used to control each of the variable impedance circuits 14 and 14*a*. In this case, when Low voltage is outputted, the second antenna 13 is set so as to act as the director while the variable impedance circuits 14 and 14*a*, and the electrical lengths of the first antenna 10 and second antenna 13 and the interval between the two are being adjusted. Similarly, when High voltage is outputted on the other hand, the second antenna 13 is set so as to act as the reflector. If done in this way, then the D/A converters 25 shown in FIGS. 1, 9, 10, 11 and 19 are omitted and alternatively the port for outputting the Low/High voltage, which is incorporated into the CPU 20 or the like, is configured so as to control each of the variable impedance circuits 14 and 14*a*. Therefore, the data stored in the memory 26, for activating the second antenna 13 as the director or reflector becomes unnecessary. Thus, as an alternative to the D/A converter 25, the portion incorporated in the CPU 20 is constructed so as to control each of the variable impedance circuits 14 and 14*a* according to the Low/High voltage signal. As a result, the variable directional antenna apparatus can be formed in a simpler configuration.

Incidentally, if the Low/High voltage signal is generated by transistors or the like, the transistors may be controlled by the CPU 20.

INDUSTRIAL APPLICABILITY

As has been described above, the variable directional antenna apparatus according to the present invention and the method of controlling the variable directional antenna are suitable for use in, for example, a portable radio apparatus capable of varying the directivity of each antenna to thereby reduce a fall in field intensity at its received position.

What is claimed is:

1. A variable directional antenna apparatus comprising:

a first antenna having an electrical length which resonates at a predetermined frequency;

a parasitic second antenna placed away from said first antenna;

electrical length varying means for changing an electrical length of said second antenna according to a control signal applied thereto;

a radio device for outputting a received signal corresponding to the intensity of an electric field received by said first antenna; and a control circuit for outputting the control signal to said electrical length varying means according to the result of detection of the received signal to thereby activate said second antenna as either a director or a reflector.

2. The variable direction antenna apparatus according to claim 1, wherein the radio device comprises a transmitter-receiver device and an antenna-shaped unit which is electrically connected to said transmitter-receiver device and shares said first antenna between transmission and reception; and a powered feeder electrically connected to said antenna shared unit and for feeding power to said first antenna.

3. The variable directional antenna apparatus according to claim 2, wherein said electrical length varying means applies a control signal to said variable capacitance diode through high-frequency inhibiting means for inhibiting a high-frequency component from passing round into said control circuit.

4. The variable directional antenna apparatus according to claim 1, wherein said electrical length varying means has a variable capacitance diode whose capacitance value varies according to the voltage of the control signal, a capacitor electrically connected in series with said variable capacitance diode, and a coil electrically connected in series with said capacitor.

5. The variable directional antenna apparatus according to claim 1, wherein said control circuit comprises an A/D converter for A/D converting a received signal, a memory for storing a predetermined value therein in advance, computing means for comparing the output of said A/D converter and the predetermined value and outputting a signal for activating said second antenna as a director or reflector according to the result of comparison, and a D/A converter for D/A converting the signal into a control signal and outputting said control signal to said electrical length varying means.

6. The variable directional antenna apparatus according to claim 1, wherein said control circuit has an A/D converter for A/D converting a received signal and computing means for outputting two kinds of control signals for activating a second antenna as a director or reflector.

7. The variable directional antenna apparatus according to claim 1, further comprising a body for holding first and second antennas therein in extended and stored states, and state detecting means for detecting the extended and stored states of the first and second antennas to thereby output an antenna state detected signal, and wherein said control circuit inputs the antenna state detected signal therein and outputs a control signal related to the extended and stored states of said first and second antennas and corresponding to a received signal outputted from said first antenna to electrical length varying means to thereby activate the second antenna held in the extended and stored states as a director or reflector.

8. The variable directional antenna apparatus according to claim 1, wherein said first and second antennas each comprise a dipole antenna.

9. The variable directional antenna apparatus according to claim 1, wherein said first and second antennas each comprise a grounded antenna.

10. The variable directional antenna apparatus according to claim 1, wherein said first and second antennas each comprise a bar-like conductor.

11. The variable directional antenna apparatus according to claim 1, wherein said first and second antennas are formed by bending conductors.

12. The variable directional antenna apparatus according to claim 1, wherein said first and second antennas are formed by mounting metal conductors on an insulating substrate.

13. The variable directional antenna apparatus comprising:

a first antenna having an electrical length which resonates at a predetermined frequency;

a parasitic second antenna disposed away from said first antenna;

a radio device for outputting a received signal corresponding to the intensity of an electric field received by said first antenna;

a speaker for outputting voice sounds received by said radio device;

electrical length varying means electrically connected to said second antenna and for varying an electrical length of said second antenna according to a control signal; and a control circuit for outputting the control signal for varying the electrical length of said second antenna so that directivity is opposite to the sound-discharge side of said speaker, to said electrical length varying means.

14. A method of controlling a variable directional antenna, comprising the following steps:

a first setting step for setting an electrical length of a second antenna placed away from a first antenna and whose electrical length is variably formed, so as to be shorter than an electrical length of said first antenna electrically connected to a receiver;

a first storing step for storing first field intensity data corresponding to the intensity of an electric field received by said receiver in a state of the electrical length of said second antenna, which is set in said first setting step, in a memory;

a second setting step for setting the electrical length of said second antenna so as to be longer than that of said first antenna;

a second storing step for storing second field intensity data corresponding to the intensity of an electric field received by said receiver in a state of the electrical length of said second antenna, which is set in said second setting step, in the memory; and a receiving step for controlling and receiving the electrical length of said second antenna according to the result of comparison between said first field intensity data and said second field intensity data.

* * * * *

UNITED STATES PATENT AND TRADEMARK OFFICE

CERTIFICATE OF CORRECTION

PATENT NO. : 6,049,310

DATED : April 11, 2000

INVENTOR(S) : Sadahiro

It is certified that error appears in the above-identified patent and that said Letters Patent is hereby corrected as shown below:

On the Coversheet: Title should read --VARIABLE DIRECTIONAL ANTENNA AND METHOD OF CONTROLLING VARIABLE DIRECTIONAL ANTENNA--; Under "PCT Filed" section, the date should be --March 18, 1997--.

In the Specification: Col. 1, title should be --VARIABLE DIRECTIONAL ANTENNA AND METHOD OF CONTROLLING VARIABLE DIRECTIONAL ANTENNA--; Col. 8, line 28, after "FIG." insert --5--; Col. 9, line 65, "converter ²5" should be --converter 25--; Col. 12, line 38, "describe d" should be --described--; Col. 12, line 49, insert a period between "respectively" and "They".

Signed and Sealed this

Tenth Day of April, 2001

*Attest:*

Nicholas P. Godici

NICHOLAS P. GODICI

*Attesting Officer*

*Acting Director of the United States Patent and Trademark Office*